United States Patent [19]

Yoshioka et al.

[11] 4,169,700

[45] Oct. 2, 1979

[54] BURNER FOR A REGENERATIVE HOT BLAST STOVE

[75] Inventors: Kengo Yoshioka; Teruichi Nozato, both of Kitakyusyu; Haruki Uchiyama, Fukuoka; Akira Satoh, Shimonoseki; Shigeo Inoue, Fukuoka; Yuji Togino, Kisarazu; Keisuke Mori, Kisarazu; Ituro Satou, Kisarazu, all of Japan

[73] Assignee: Nippon Steel Corporation, Otemachi, Japan

[21] Appl. No.: 830,319

[22] Filed: Sep. 2, 1977

[30] Foreign Application Priority Data

Sep. 10, 1976 [JP] Japan ..... 51/108477

[51] Int. Cl.[2] ..... F23C 5/00; F24H 7/00

[52] U.S. Cl. ..... 431/174; 431/285; 432/214

[58] Field of Search ..... 432/214, 216, 217; 431/170, 174, 178, 179, 285

[56] References Cited

U.S. PATENT DOCUMENTS

| | | | |
|---|---|---|---|
| 328,914 | 10/1885 | Ashcroft | 431/179 |
| 2,395,276 | 2/1946 | Jordan | 431/178 |
| 3,771,944 | 11/1973 | Hovis et al. | 431/174 |
| 3,837,793 | 9/1974 | Lucieer et al. | 432/217 |

FOREIGN PATENT DOCUMENTS

| | | | |
|---|---|---|---|
| 687431 | 4/1930 | France | 431/178 |

*Primary Examiner*—Carroll B. Dority, Jr.
*Attorney, Agent, or Firm*—Wenderoth, Lind & Ponack

[57] ABSTRACT

A burner for a regenerative hot blast stove has an upper block containing a burner tile portion having a plurality of burner ports and being inserted removably into the bottom of the hot blast stove; a lower section containing a combustion gas header and a combustion air header and a plurality of unit burners extending from the burner ports into the lower section, said unit burners having a passage for combustion gas and a passage for combustion air, respectively communicating at their one end to the combustion gas header and the combustion air header, and communicating at their other end to the burner port.

2 Claims, 9 Drawing Figures

BURNER FOR A REGENERATIVE HOT BLAST STOVE

FIELD OF THE INVENTION

This invention relates to a burner for a regenerative hot blast stove widely used as a hot blast generating device for blast furnaces in the steel making industry as well as in general industrial furnaces.

In a regenerative stove the out-burning type commonly used in iron-making blast furnace equipment, two cylindrical shells are communicated with each other at their top portions, and one of the shell serves as a regenerative chamber composed of a checker work structure which serves as heat-exchanging media, and the other shell serves as a combustion furnace composed of a combustion chamber providing space for fuel combustion and a refractory furnace wall.

The regenerative blast stove has a burner at the lower end of the combustion furnace and in this burner fuels easily available at low cost, such as blast furnace gas, coke-oven gas and natural gas are burnt to heat the bricks in the regenerative furnace into which cold blast air is supplied from its lower end, and the hot blast thus created in the regenerative furnace is supplied to a blast furnace through the hot blast outlet provided at one end of the combustion furnace.

Normally two or more regenerative hot blast stoves are provided for each blast furnace, and are used alternatively for combustion and heating at regular intervals to continuously supply hot blast to the blast furnace.

The present invention particularly relates to a burner useful in the regenerative hot blast stove of outer-combustion type.

Conventionally, so-called ceramic burners are widely used, in which all of the passages for fuel and combustion air are constructed of refractory ceramic bricks.

As the refractory bricks used in the ceramic burner, high-alumina bricks containing 60–70% $Al_2O_3$ are used in high temperature sections around the burner ports and chamotte bricks containing 34–45% $Al_2O_3$ are used in lower-temperature sections at the lower portion of the burner.

The ceramic burner is an assembly of small burner ports, and has such advantages that the flame continuity near the ports is excellent even when the combustion rate per unit time is large, that the burner is less susceptible to periodical fluctuations in the burning flame and the furnace pressure due to the combustion vibration and inferior flame continuity as very often seen in a large-diameter and large capacity burner, and that the flame stability is high. However, the ceramic burner has an inherent defect that the replacement or repair thereof is very difficult because of the furnace character, and it is almost impossible to change the shape of the burning flames.

A detailed description will be given of a conventional typical structure of a ceramic burner, and the structure of a burner according to the present invention with reference the attached drawings.

BRIEF DESCRIPTION OF THE DRAWINGS

FIG. 7 (*a*) is a cross section taken along the lines *7a—7a* in FIG. 7.

FIG. 7(*b*) is a cross section taken along the line *7b—7b* in FIG. 7.

In FIG. 1, the combustion furnace 1 and the regenerative furnace 2 are connected to each other through a connecting pipe 3 a their top portions, and the burner 4 is provided at the lower end of the combustion furnace 1.

Figure 1:
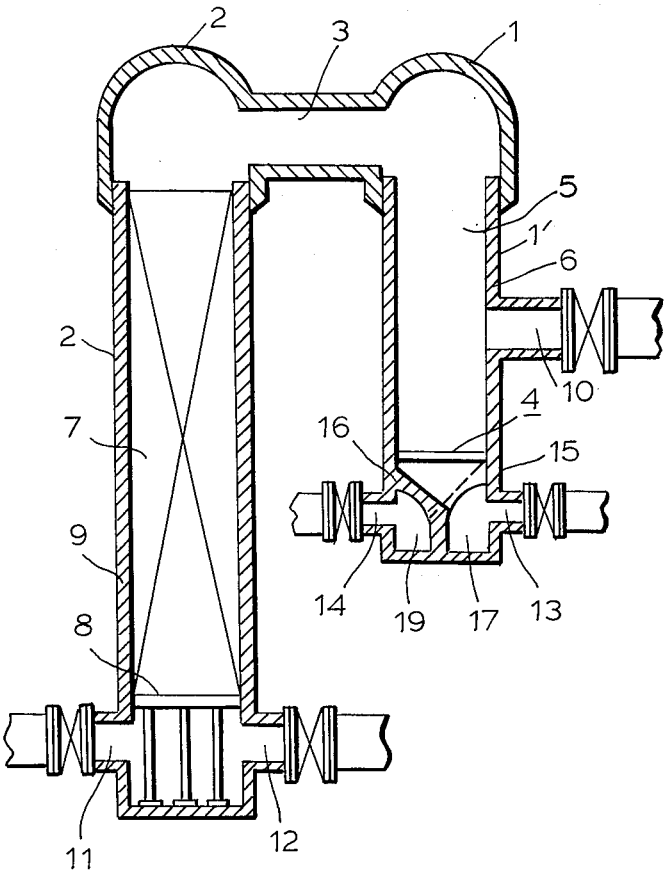
FIG.1 (PRIOR ART)
FIG. 1 is a longitudinal cross section of a blast stove having a burner section of conventional structure.

The combustion furnace comprises a combustion space 5 and a refractory furnace wall 6 within a shell 1', while the regenerative furnace 2 comprises a checker work 7 which serves as the heating medium, a checker work support 8 and a refractory furnace wall 9 within a shell.

The combustion furnace 1 further comprises an outlet 10 for heated hot blast, and the regenerative furnace 2 further comprises an outlet 11 provided at its lower portion for combustion exhaust gas, an inlet 12 for cold blast air for heating. The burner 4 comprises an inlet 13 for fuel on one side and an inlet 14 for combustion air on the other side, each having a cut-off valve which is opened and closed to effect change-over between the blasting stage and the combustion stage.

Figure 2:
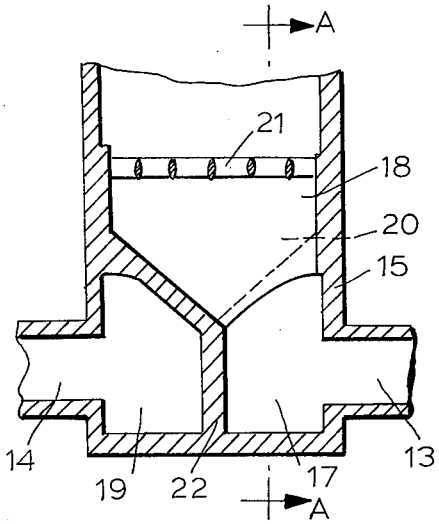
FIG.2 (PRIOR ART)
FIG. 2 is an enlarged sectional view of the burner section of the stove of FIG. 1.
Figure 3:
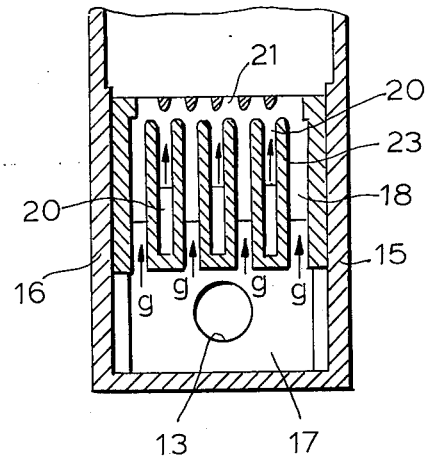
FIG.3 (PRIOR ART)
FIG. 3 is a cross sectional view taken along A—A in FIG. 2.

The structure of the ceramic burner shown in FIG. 1 is shown in detail in FIG. 2 and FIG. 3.

The ceramic burner is mounted in a shell 15 having a refractory wall 16 and continuously extending from and supporting the shell 1' having the refractory wall 6 of the combustion furnace 1, therein and comprises a header chamber 17 for fuel, a burner port 21, diversion passages 18 to the burner port, a header chamber 19 for air and diversion passages 20 to the burner port 21, and a premixing and ignition zone for fuel and air provided above the diversion passages. The header chambers are communicated respectively with the fuel conduit 13 and the air conduit 14.

The diversion passages 18 and 20 are separated from each other by means of separation walls 23 constructed of ceramic bricks, and are arranged adjacent to each other so as to position the flows of air and fuel adjacent to each other in an alternative way. Also the fuel header 17 and the air header 19 are adjacent to each other with a separation wall 22 constructed of ceramic bricks therebetween, and diverge toward one side of the burner port occupying the whole traverse cross section of the combustion chamber.

A description will be given hereinbelow of the structural materials of the conventional burner and the service conditions.

(1) The ceramic brick usually has 15 to 28% porosity so that water or a sublimating substance, such as $NH_3(SO_4)$ can easily penetrate the surface portion of the brick, and the mortar binding the bricks together often flows out of the joints due to the water content of the gas and a the drain in a low-temperature zone where the ambient temperature can not develop fully the binding force of the mortar.

(2) The temperature in the portion from the header chambers to the burner tail and constituting the ceramic burner changes extremely depending on the stages of operations. Thus in the combustion stage, the temperature is near that of the non-burnt fuel or the air, and in the blasting stage the burner port is exposed to higher temperatures than the temperatures the lower portion is exposed to when the hot blast enters during the pressure charging and the heat radiation.

(3) As the fuel used in the burner, blast furnace gas or the coke oven gas is usually used. These gases contain moisture mixed therein in a super-saturated state or in a mist, amounting to 60–70 g/Nm$^3$, and in some cases in excess of 100 g/Nm$^3$. This moisture content of the gas wets and flows over the porous surface of the ceramic bricks and the mortar surface.

Due to the above described structure of the conventional burner and the service conditions, the conventional ceramic burner encounters the following problems and disadvantages.

Although the conventional ceramic burner is excellent in respect to the combustion stability, the following defects and problems have been experienced in the actual operation due to the structural materials, the structural design and the service conditions.

(1) As the fuel header and the air header communicating with the burner port expand laterally, there is caused deviation in the fuel jets and the combustion air jets in the burner port so those the amount of fuel jet just above the fuel header tends to be smaller than that just above the air header, and a similar tendency is present in connection with the air jet. Therefore, the air/fuel ratio, which should be normally uniform in the burner port, fluctuates by 10–20% so that it is impossible to obtain satisfactorily uniform combustion and temperature distribution across the whole cross section of the combustion chamber. The inferior combustion efficiency causes a low thermal efficiency and the elongating burning flames and the non-uniform temperature distribution cause local damages to the walls and the checker work. Therefore up to now, no ceramic burner which has a satisfactorily uniform combustion distribution character has ever been developed despite various efforts and trials. (2) Due to the repeated sharp changes in temperature and humidity caused by the alternation of the blasting stage and the combustion stage, the ceramic bricks constituting the burner are damaged by thermal spalling and sulfides present in a very small amount in the gas penetrate the brick surface together with the mist during the combustion stage, and are sublimated by the sharp temperature rise during the blasting stage and the moisture is also vaporized rapidly so that the ceramic bricks are stripped and it is often necessary to repair or replace the bricks during the life of the stove. (3) In a conventional burner structure, because the shell containing the burner is continuous with that of the combustion furnace, it is impossible to remove the shell and the brick repair or replacement must be done within the furnace. However, it is impossible to perform the repair or replacement in the furnace when the burner is exposed to the heat radiation from the furnace wall heated to a temperature ranging from 1000° to 1500° C.

Therefore, the brick repair or replacement, if required during the operation of the furnace, requires the stopping of the furnace operation so as to cool the furnace for a long period of time and then to reheat it, which often amounts to about 60 , for both the cooling period and the heating period thus reducing the amount of air blast supplied to the blast furnace by 30 to 40% and considerably reducing the productivity. (4) The regenerative blast stove can be used almost semipermanently as long as temperatures are continuously maintained in a certain range, but once cooled, refractory walls suffer from cracks due to deformation and contraction during the cooling, and the reliability of the stove after the reheating is greatly reduced and also the functioning of the stove is adversely affected. A conventional ceramic burner normally has a service life not longer than the life of a blast furnace and so in order to use the hot stove for several lives of a blast furnace, it is necessary to repair the burner, and in order to repair the burner, it is necessary to cool the whole hot blast stove and it is difficult to achieve a highly reliable operation of the hot blast stove without repairs. (5) The burning flames tend to be elongated due to the inferior air-fuel ratio in the individual burner ports and the highest temperature zone in the stove tends to shift from the combustion chamber to the upper portion of the regenerative chamber due to non-uniform temperature distribution. Therefore, the temperature of the combustion chamber, particularly near the hot blast outlet is lower than the temperature of the blast heated by the checker work during the blasting stage, so that the proper operation of the regenerative hot blast stove to obtain a higher temperature of the blast efficiently is adversely affected. (6) Even when one tries to change the temperature distribution in the combustion chamber and the profile of the individual burner port to a satisfactory pattern or profile, it is very difficult, or almost impossible, to perform the changes during the operation of the blast stove because the burner is constructed integrally with the combustion furnace.

As above described, the conventional ceramic burner causes various problems in respect of the function of the blast stove, reliability in operation, maintenance and capital cost.

Therefore, the object of the present invention is to solve the problems and defects of the conventional ceramic burner without sacrifying its advantage of combustion stability.

More particularly, the present invention seeks to achieve the following advantageous results.

(1) Combustion stability for a large capacity burner by assembling (integrating) burner ports of small diameter.

(2) Replacement of ceramic bricks susceptible to damage due to the mist contained in the fuel with metallic materials having high resistance to the mist, and combination of ceramic materials and metallic materials.

(3) Header arrangement which assures uniform jet flow of the fuel and combustion air all over the whole area of the burner port.

(4) A single-burner structure and arrangement which enables improvement and adjustment of the temperature distribution in the combustion chamber during the operation.

(5) A burner structure which permits repair and replacement in a short period of time without damaging the hot blast stove in case of necessity of repair due to damage of the structural materials or in case of necessity of improving the combustion during the blast stove operation.

(6) Improvement of combustion efficiency and enhancement of the blast temperature by a uniform temperature distribution and shortening of the flames.

(7) Economical advantage resulting from shortening of the construction period due to the light-weight structure and the prefabrication system.

(8) Ready response to optional combustion capacity by changing the number of single burners and simplification of the burner design.

DETAILED DESCRIPTION OF THE INVENTION

The present invention will be described in more detail with reference to FIG. 4 to FIG. 6 which show an embodiment of the present invention in which coke-oven gas having a higher calorie and blast furnace gas having a lower calorie value are not premixed with each other.

Figure 4:
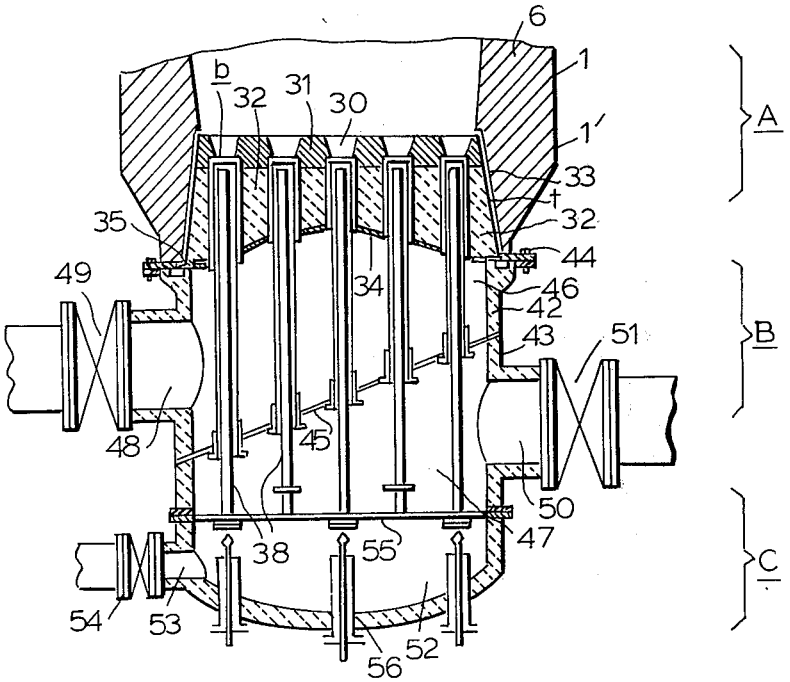
FIG. 4 is a longitudinal cross section of a burner according to the present invention.
Figure 5:
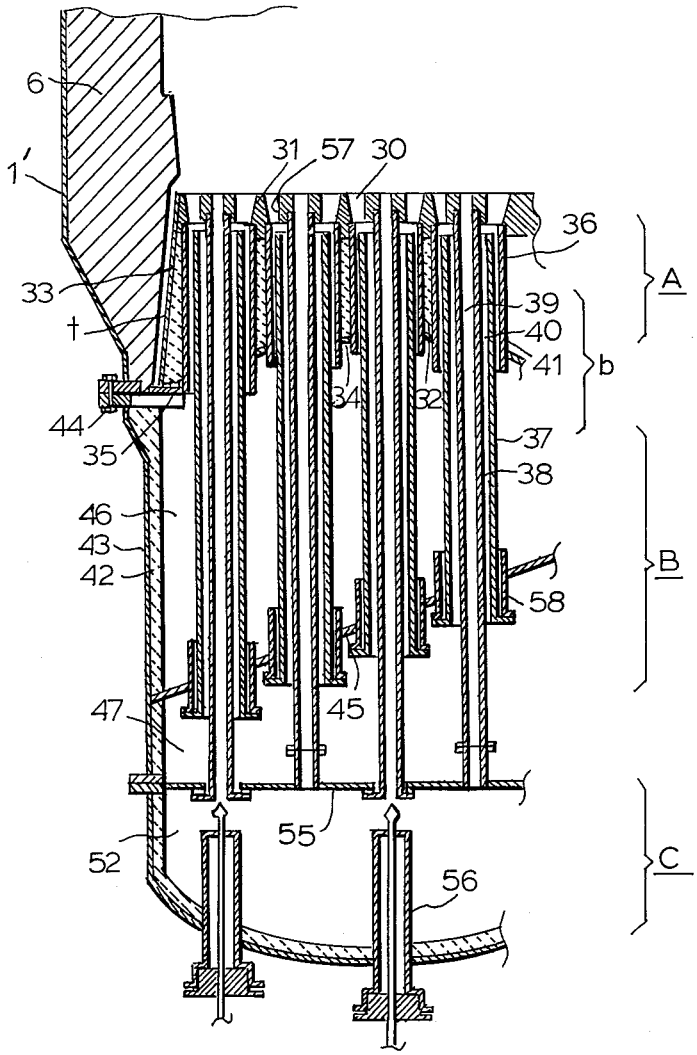
FIG. 5 is a sectional view on an enlarged scale showing details of a part of the burner of FIG. 4.
Figure 6:
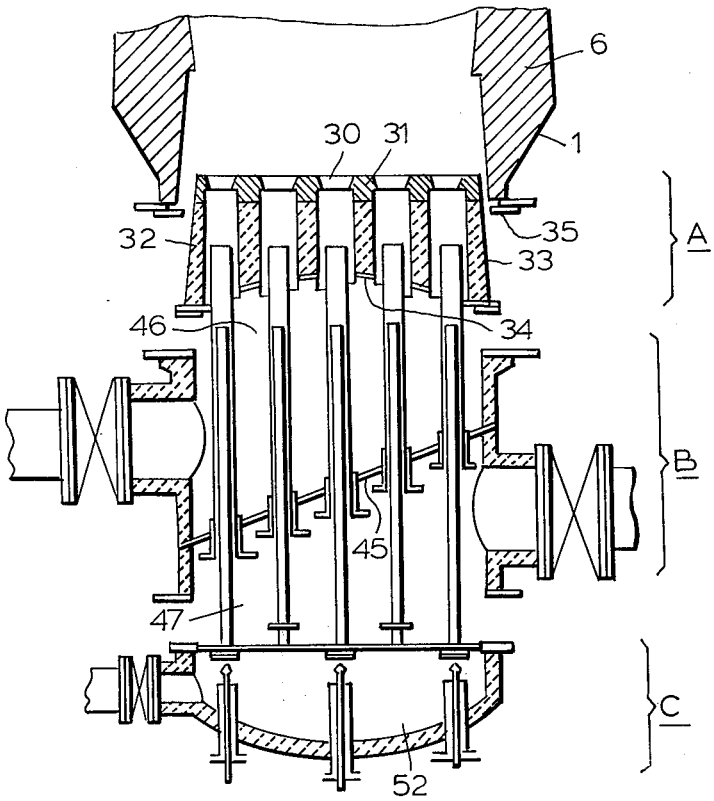
FIG. 6 shows the manner of replacement of the burner shown in FIG. 4.

In FIG. 4 to FIG. 6, A represents the upper section of the burner structure according to the present invention. In this upper section is a burner tile portion 31 having burner opening 30 therein, and is composed of ceramic bricks having an excellent flame-holding property and excellent heat resistance. A cast ceramic body 32 is positioned below the burner tile portion 31 and a metallic (such as an austenic stainless steel JIS SUS310S) side plate 33 surrounds the outside of the body. A metallic partition plate 34 is provided on the bottom surface of the upper section A.

The upper section A is inserted into the bottom portion of the combustion furnace 1 in a hot blast stove, and removably supported by a support 35 extending from the inside of the lower end of shell 1' of the combustion furnace 1. The side plate 33 of the upper section A is separated from the refractory wall 6 of the combustion furnace by a space t so as to facilitate mounting and dismounting of the upper section.

A unit burner b is provided having a passage for combustion air and a passage for combustion fuel and communicating at its upper end with the lower end of each burner opening 30 through bores in casting 32. A plurality of such unit burners constitute the complex burner structure. Each unit burner b is a triple pipe composed of an external blast furnace gas pipe 36, a concentric air pipe 37 within the pipe 6, and a coke oven gas pipe 38 within the air pipe 37 providing a passage 39 for the coke oven gas there within and defining with pipe 37 a passage 40 for the combustion air. Pipe 37 defines with pipe 36 a passage 41 for the blast furnace gas.

The blast furnace gas pipe 36 is supported by the upper section A, the combustion air pipe 37 is supported by an attaching member 58 fixed to a partition plate 45 provided in an intermediate section B described hereinafter, and the coke oven gas pipe 38 is supported by a partition plate 55 provided at the upper portion of the lower section C. In order to reduce their weight and improve their life, all of the pipes constituting the unit burner are made of metal, because they are in a zone in which they are exposed to the mist contained in the gas at relatively low temperatures just as the partition plate 34 and the side plate 33 in the upper section A. Although these pipes are shown as being arranged coaxially, they may be arranged side by side.

The intermediate section B of the burner structure according to the present invention comprises a heat-insulating refractory material wall 42 and an outer shell 43 covering the refractory material 42. The outer shell 43 is removably connected to the shell 1' of the combustion furnace of the hot blast stove by means of bolts 44 or the like. The intermediate section B is divided into upper and lower sections by the partition plate 45, the sections forming the blast furnace gas header 46 and the combustion air header 47, respectively. An inlet opening 48 is provided to the blast furnace gas header 46 and a cut-off valve 49 is provided in the inlet opening, and an inlet opening 50 is provided to the combustion air header 47 and a cut-off valve 51 is provided therein. The positional arrangement of the above headers is not necessarily limited to the arrangement shown in the drawings, but they may be arranged in a contrary manner. The blast furnace gas header 46 is communicated with the blast furnace gas passage 41 and the combustion air header 47 is communicated with the combustion air passage 40 in each unit burner b.

The lower section C of the burner according to the present invention is removably connected to the intermediate section B by means of bolts or the like. In the embodiment shown, the lower section C is used as the coke over gas header 52. The positional arrangement of this header is not limited to the one shown in the drawings.

An inlet opening 53 is provided to the coke oven gas header 52 and a cut-off valve 54 is provided therein. A gas tight partition plate 55 divides the header into an upper section and a lower section, and an adjusting mechanism 56, such as a cone control valve, is provided for adjusting the flow rate of the air or the fuel gas for each of the unit burners. The operation end of the adjusting mechanism is outside the burner structure so as to enable the adjustment of individual flames from outside.

In the above embodiment of the present invention, the structure is designed to control the flow rate of the coke oven gas, but the present invention is not limited to this structure and the gas which is controlled varies depending on the header which is positioned at the lowest position.

Also in the above embodiment, coke oven gas is used and for this purpose the lower section C is used, but where the coke oven gas and blast furnace gas are premixed it is not necessary to provide the lower section C. In such a case, the adjusting mechanism 56 is provided at the bottom of the intermediate section B for adjusting the flow rate of the air or the fuel gas.

A stabilizer 57 is provided in each burner opening 30 to continuously hold the flame for combustion stabilization and to minimize the fluctuation of the combustion.

In the above embodiment, when the burner assembly is to be removed for repairs, the fastening bolts for the upper, intermediate and lower sections are removed to disassemble the burner assembly and the combustion air pipes 37 and the coke oven gas pipes 38 are taken out as shown in FIG. 6 and can be replaced.

In the above embodiment, the two kinds of fuels are used without pre-mixing, but the present invention is also applicable to the cases where only one kind of fuel is used or two kinds of fuels are pre-mixed.

Where one kind fuel is used, the coke oven gas header and the coke oven gas pipe are not necessary so that the structure is more simple and has a lower weight.

Figure 7:
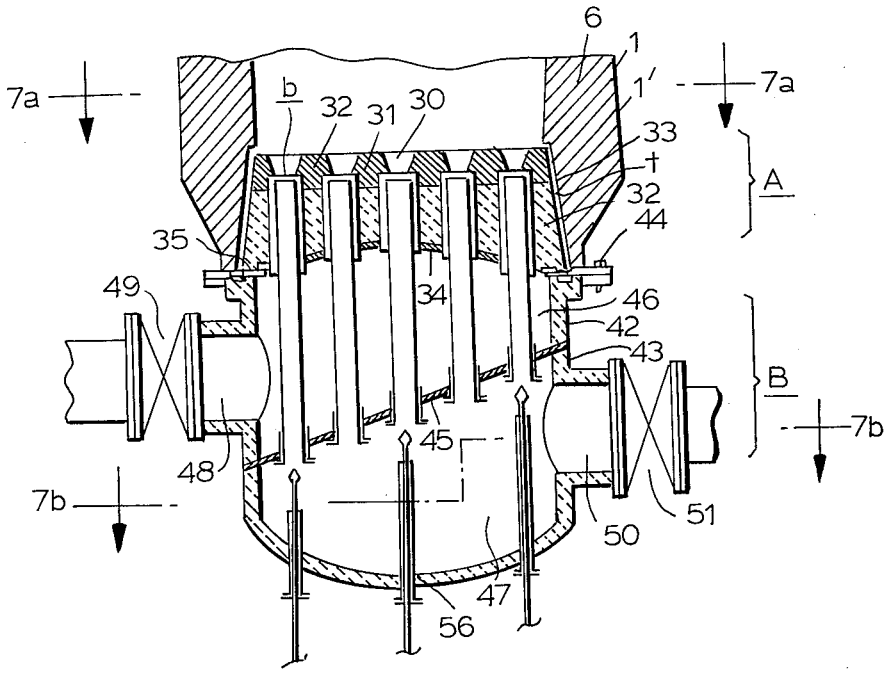
FIG. 7 is a sectional view showing another embodiment of the present invention and which has been simplified by omitting the coke oven gas header.
Figure 7A:
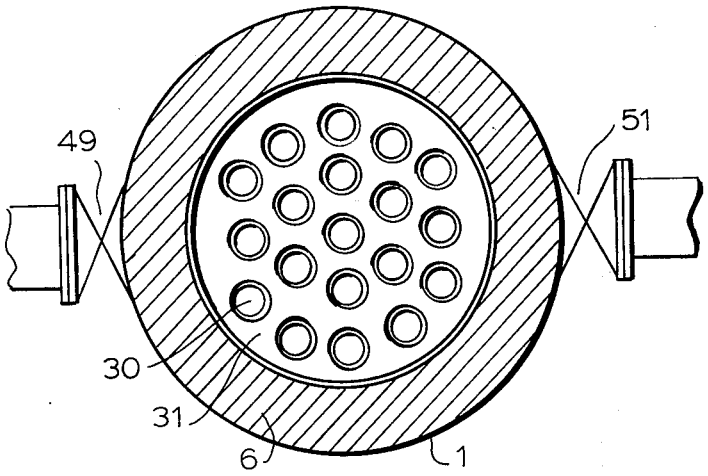
Figure 7B:
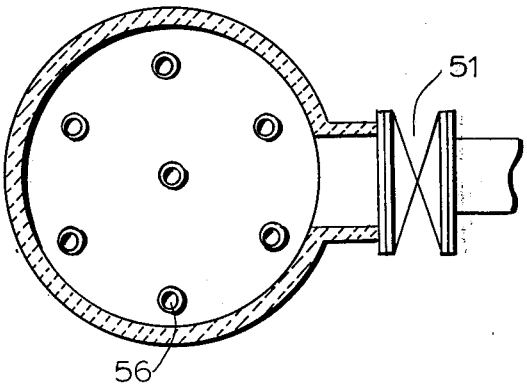

FIG. 7 shows an embodiment of the present invention simplified by omitting the coke oven gas header described above.

The burner structure shown in FIG. 7 is composed of an upper section A, including burner openings 30, and a lower section B, including a blast furnace gas header 46 and a combustion air header 47. The upper section A is inserted into the lower end of the combustion furnace shell with a space (t) left therearound and is removably supported by a fastening fitting 35 extending from the combustion furnace shell.

The number of burner openings 30, as shown in FIG. *7a*, is 19 and each has a single unit burner therein. Depending on the burner capacity required, there can be 7 to 27 unit burners, for example.

The section A has a side plate 33 surrounding a cast ceramic member 32, a plurality of unit burners b extending through the member 32 and a partition plate 34 being provided on the lower surface of the member 32, and a burner tile 31 has the burner openings therein and is positioned on the top of the member 32, and section A is separated from section B by a partition plate 34.

Each unit burner is a double-pipe structure composed of an inner pipe and an outer-pipe with a space therebetween, with the lower end of the outer pipe extending into the blast furnace gas header 46 while the lower end of the inner pipe extends into the combustion air header 47.

The combustion gas is admitted into the inner pipe from its lower end, and the blast furnace gas is admitted into the space provided between the inner pipe and outer pipe from the lower end of the outer pipe and both gases are introduced to the burner opening where they are burnt.

In the section B which is defined by the outer shell 43 lined with heat-insulating refractory material, the blast gas header 46 and the combustion air header 47 are separated from each other by means of a partition plate 45. The inner pipe of each unit burner extends through the blast furnace gas header 46 into the combustion air header 47. The blast furnace header 46 is provided with an inlet 48 having a cut-off valve 49 for introducing the blast furnace gas and the combustion air header 47 is provided with an inlet having a cut-off valve 51 for introducing the combustion air.

A control means 56, such as a cone control valve for adjusting the flow rate of the fuel gas and air, is provided for each of the unit burners, and the lower end of each control valve projects outside the outer shell 43 so that the adjustment of the flow rate can be performed from outside. As shown in FIG. *7b*, the control means 56 is formed by seven control valves, for example.

Section B is removably mounted on the lower end of the shell of the combustion furnace so that it is possible to remove section B and then section A separately for repair or replacement.

In case of necessity, it is also possible to use the liquid fuel as a substitute for the coke oven gas.

The advantageous results achieved by the present invention are listed below.

(1) As the materials for the burner components members there are used metallic materials having better resistance to thermal spalling and mist than ceramic materials in combination with ceramic materials having excellent heat resistance in the atmospheric conditions to which the burner component members are exposed so conditions similar to the stripping of the ceramic bricks due to thermal spalling and mist contained in the gases as often seen in the conventional burners is effectively prevented and thereby the structural reliability is improved.

(2) Because the traverse cross sections of the fuel header and the combustion air header connected to the burner ports through the unit burners are almost equal to the area of the burner part in which the burner ports are formed, a uniform flow rate of the air and the fuel can be achieved so that combustion efficiency and thermal efficiency are improved due to a proper air-fuel ratio, and the flame length can be adjusted correctly and a uniform temperature distribution all through the combustion chamber can be maintained to provide an ideal combustion pattern which has not been achieved by the conventional burners.

(3) Because the metallic burner according to the present invention is divided into a plurality of small sections, and is fastened to the combustion furnace shell by means of fastening means, such as bolts and nuts, the burner can be freely mounted on or detached from the combustion furnace and repairs and reconstruction for improvement of the combustion can be performed even when the furnace is heated to high temperatures above 1000° C.

(4) Because the burner according to the present invention can be freely mounted on or removed from the combustion furnace shell, and the burner can be repaired without cooling or damaging the combustion furnace, it is possible to maintain the refractories of the combustion furnace at the required high temperature so that the service life of the burner can be increased to several times longer than the life of the blast furnace and great economical advantages can be achieved. The burner according to the present invention can be replaced from outside the blast stove in several days.

(5) Because the burner according to the present invention uses an assembly of unit burners, it is possible to adjust and control the temperature distribution within the combustion chamber by appropriately combining unit burners having different combustion capacities and combustion characters, and the range in which the temperature distribution can be adjusted and controlled is considerably wider than that for a conventional burner.

What is claimed is:

1. In a regenerative hot blast stove, the combination of a refractory furnace wall with a burner port in the bottom thereof and a shell on the outside of said wall, support means on the lower end of said shell extending inwardly from said shell, a burner structure having an upper section with a plurality of burner openings therein, and a lower section having means dividing the lower section into an upper and lower gas header and a plurality of unit burners extending from the burner openings into the lower section, each burner unit having a central flow path extending into the lower gas header and an outer flow path extending into the upper header, upper section mounting means on said upper section for removably mounting said upper section on said support means with said upper section in said burner port with the periphery of said upper section spaced a uniform distance from the portion of the furnace wall defining said burner port, and lower section mounting means removably mounting said lower section on said support means, and an adjusting mechanism at the end of the central flow path of at least some of the unit burners in the lower section for independently adjusting the flow rate through the burner unit from the lower section.

2. The combination as claimed in claim 1 further comprising partition means defining an intermediate gas header in said lower section between said upper and lower gas header, and said unit burners each having an intermediate flow path extending from the corresponding burner opening and opening into said intermediate gas header, and said lower gas header having mounting means thereon for removably mounting said lower gas header on the portion of said lower portion containing said upper and intermediate gas headers.

* * * * *